US006773514B1

(12) United States Patent
Kawalla et al.

(10) Patent No.: US 6,773,514 B1
(45) Date of Patent: Aug. 10, 2004

(54) METHOD FOR PRODUCING NON-GRAIN ORIENTED ELECTRIC SHEET STEEL

(75) Inventors: Rudolf Kawalla, Niederbobritzsch (DE); Hans Pircher, Mülheim (DE); Karl Ernst Friedrich, Moers (DE); Brigitte Hammer, Voerde (DE); Jürgen Schneider, Bochum (DE); Olaf Fischer, Bochum (DE); Carl-Dieter Wuppermann, Krefeld (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 10/030,259

(22) PCT Filed: Apr. 7, 2000

(86) PCT No.: PCT/EP00/03125

§ 371 (c)(1),
(2), (4) Date: Jun. 6, 2002

(87) PCT Pub. No.: WO01/02610

PCT Pub. Date: Jan. 11, 2001

(30) Foreign Application Priority Data

Jul. 5, 1909 (DE) ..... 199 30 519

(51) Int. Cl.[7] ..... H01F 1/00

(52) U.S. Cl. ..... 148/121; 148/120; 148/111; 148/112

(58) Field of Search ..... 148/110, 111, 148/112, 120, 121

(56) References Cited

U.S. PATENT DOCUMENTS

| | | | | |
|---|---|---|---|---|
| 4,177,091 A | * | 12/1979 | Fiedler | 148/111 |
| 5,803,989 A | | 9/1998 | Kawamata et al. | 148/120 |
| 6,503,339 B1 | * | 1/2003 | Pircher et al. | 148/120 |

FOREIGN PATENT DOCUMENTS

| | | |
|---|---|---|
| EP | 0469980 | 2/1992 |
| JP | 01168815 | 7/1989 |
| JP | 06287639 | 10/1994 |

* cited by examiner

*Primary Examiner*—John P. Sheehan
(74) *Attorney, Agent, or Firm*—Proskauer Rose LLP

(57) ABSTRACT

The present invention relates to a method for producing non grain-oriented magnetic steel sheets in which hot strip is produced from an input stock such as cast slabs, strip, roughed strip, or thin slabs, made of steel comprising (in weight %) C: 0.001–0.05%; Si: ≦1.5%; Al: ≦0.4% with Si+2Al≦1.7%; Mn: 0.1–1.2%; if necessary up to a total of 1.5% of alloying additions such as P, Sn, Sb, Zr, V, Ti, N, Ni, Co, Nb and/or B; with the remainder being iron as well as the usual accompanying elements; in that the input stock is hot-rolled directly from the casting heat or after preceding reheating to a reheating temperature between min. 1000° C. and max. 1180° C. in several deformation passes, and subsequently coiled, wherein during hot-rolling at least the first deformation pass takes place in the austenitic region and at least one further deformation pass takes place in the two-phase mixing region austenite/ferrite, and wherein during rolling in the two-phase mixing region a total deformation $\epsilon_h$ of at least 35% is achieved.

44 Claims, No Drawings

METHOD FOR PRODUCING NON-GRAIN ORIENTED ELECTRIC SHEET STEEL

BACKGROUND OF THE INVENTION

The invention relates to a method for producing non grain-oriented magnetic steel sheets in which hot strip is produced from an input stock made of steel, such as cast slabs, strip, roughed strip, or thin slabs, wherein the magnetic steel sheets have little hysteresis loss and high polarisation, as well as good mechanical properties. Such non grain-oriented magnetic steel sheets are predominantly used as core material in electrical machinery such as motors and generators with a rotating direction of magnetic flux.

In this document the term "non grain-oriented magnetic steel sheets" refers to magnetic steel sheets covered by DIN EN 10106 ("magnetic steel sheets subjected to final annealing") and DIN EN 10165 ("magnetic steel sheets not subjected to final annealing"). Furthermore, more strongly anisotropic types are also included provided they are not deemed to fall into the category of grain-oriented magnetic sheets.

The processing industry demands non grain-oriented magnetic steel sheets whose magnetic properties are better than those of conventional sheets of this type. There is a demand for reduced hysteresis loss coupled with an increased polarisation in the particular induction range used. At the same time, the respective treatment and processing steps to which the magnetic steel sheets are subjected in the context of their use, place special demands on the mechanical/technological characteristics of said magnetic steel sheets. In this context, cuttability of the sheets, e.g. during stamping, assumes particular importance.

By increasing magnetic polarisation, the magnetisation requirement is reduced. At the same time, copper losses are reduced too, said copper losses forming a significant part of the losses which arise during the operation of electrical machinery. The economic value of non grain-oriented magnetic steel sheets with increased permeability is thus very considerable.

The demand for types of non grain-oriented magnetic steel sheets which have greater permeability, not only relates to non grain-oriented magnetic steel sheets with high losses (P1.5≧5–6 W/kg), but also sheets with medium losses (3.5 W/kg≦P1.5≦5.5 W/kg) and low losses (P1.2≦3.5). This is the reason for efforts to improve the entire spectrum of the magnetic polarisation values of lightly siliconised, medium-siliconised and highly siliconised electrotechnical steels.

One approach to producing magnetic steel sheets of increased permeability, said approach being based on medium-siliconised or lightly siliconised alloys, consists of subjecting the hot strip to hot strip annealing during production. Thus for example WO 96/00306 proposes that hot strip intended for the production of magnetic steel sheets, be finish-rolled in the austenitic region, and that coiling be undertaken at temperatures above the complete transformation to ferrite. In addition, annealing of the coil takes place directly from the rolling heat. In this way a final product with good magnetic characteristics is obtained. However, due to the high energy requirements for heating before and after hot-rolling as well as due to the required alloying additions, the associated increased costs have to be accepted.

According to EP 0 469 980 an increased coiling temperature in combination with an additional hot strip annealing should be aimed for, so as to obtain useful magnetic characteristics even with low alloying contents. This too can only be accomplished if the increased costs are accepted.

SUMMARY OF THE INVENTION

It is thus the object of the invention to provide an economical way of producing magnetic steel sheets with improved characteristics.

According to the invention, this object is met by a method for producing non grain-oriented magnetic steel sheets in which, starting with an input stock such as cast slabs, strip or thin slabs made from a steel comprising (in weight %) 0.001–0.05% C, ≦1.5% Si, ≦0.4% Al, with Si+2Al≦1.7%, 0.1–1.2% Mn, if necessary up to a total of 1.5% alloying additions such as P, Sn, Sb, Zr, V, Ti, N, Ni, Co, Nb and/or B, with the remainder being iron as well as the usual accompanying elements, a hot strip is produced in that the input stock is hot-rolled directly from the casting heat or after preceding reheating to a reheating temperature between min. 1000° C. and max. 1180° C. in several deformation passes, and subsequently coiled, wherein during hot-rolling at least the first deformation pass takes place in the austenitic region and at least one further deformation pass takes place in the two-phase mixing region austenite/ferrite, and wherein during rolling in the two-phase mixing region a total deformation $\epsilon_h$ of at least 35% is achieved.

According to the invention, the magnetic characteristics of magnetic steel sheets are influenced in a targeted way by deformation during the individual deformation passes undertaken during hot-rolling, depending on the respective microstructural condition at the time. Rolling in the two-phase mixing region is to be a decisive component; by contrast, the component of deformation in the ferritic region should be kept as small as possible. Thus the method according to the invention is particularly suitable for processing those Fe—Si alloys that have a pronounced two-phase mixing region between the austenitic and the ferritic region.

Attuning the alloying additions of ferrite-forming and austenite-forming elements, taking into account the contents range according to the invention of the individual elements, is to be undertaken starting with a base composition of (Si+2Al)≦1.7, namely such that there is an adequate distinction of the two-phase mixing region.

If cast slabs are used as an input stock, they are reheated to a temperature ≧1000° C. so that the material is completely in the austenitic state. For the same reason, cast thin slabs or cast strip are/is used directly exploiting the casting heat and if necessary are heated up to an initial rolling temperature exceeding 1000° C. The required reheating temperature increases in line with an increase in the Si content, but an upper limit of 1180° C. is not to be exceeded.

As a rule, hot-rolling according to the invention is carried out in a finish-rolling line comprising several roll stands. The purpose of rolling in the austenitic region which takes place in a single pass or in several passes, consists of being able to carry out the transition from the austenitic region to the two-phase mixing region and from the two-phase mixing region to the ferritic region in a controlled way within the finish-rolling line. The deformation passes carried out in the austenitic region also serve the purpose of setting the thickness of the hot strip prior to the start of rolling in the two-phase mixing region so that the desired total deformation taking place during rolling in the two-phase mixing region ("mixing rolling") is safely attained. Mixing rolling also involves at least one deformation pass. Preferably however, several deformation passes are carried out in the mixing region austenite/ferrite, so as to safely achieve the total deformation of at least 35% required during such mixing rolling, thus obtaining the desired setting of the microstructure of the hot strip.

The term "total deformation $\epsilon_h$" refers to the ratio of thickness reduction during rolling in the respective phase region to the thickness of the strip when it enters the respective phase region. According to this definition, the thickness of hot strip produced according to the invention, for example after rolling in the austenitic region, is $h_0$. During subsequent rolling in the two-phase mixing region, the thickness of the hot strip is reduced to $h_1$. According to the definition, this results for example, in a total deformation $\epsilon_h$ attained during mixing rolling to $(h_0-h_1)/h_0$ with $h_0$=thickness during entry into the first roll stand which is passed in the mixing state austenite/ferrite, and $h_1$=thickness when leaving the last roll stand in the mixing state.

According to the invention, the total deformation $\epsilon_h$ during rolling in the two-phase mixing region austenite/ferrite is to amount to at least 35%, so as to set or prepare for the subsequent process steps a condition of the hot-rolled strip concerning grain size, texture and precipitations, which condition favours the desired magnetic and technological characteristics. Ideal processing results can be achieved if the total deformation in the two-phase mixing region austenite/ferrite is limited to max. 60%.

By hot-rolling, which predominantly is a mixing rolling, avoiding rolling in the ferritic region as far as possible, a hot strip can be produced which can subsequently be used for the production of magnetic steel sheets and for the production of components with outstanding magnetic characteristics. To this effect, no additional process steps or the need to maintain certain elevated temperatures during hot-rolling, are required. Instead, by implementing a rolling strategy which is optimised both in regard to temperature management and in regard to staggering the deformation passes, in conjunction with a suitable coiling temperature, the method according to the invention makes it possible to economically produce a high-quality magnetic steel sheet material.

It has been shown that merely combining the measures according to the invention with maintaining the range of deformation of 35% to 60% for deformation in the mixing region austenite/ferrite, as provided by the invention, magnetic steel sheets can be produced whose characteristics match those of magnetic steel sheets produced in a conventional way which in addition have passed through time-consuming and expensive process steps such as supplementary hot-strip annealing. Furthermore it has been shown that in cases where hot-strip annealing is carried out to supplement the method according to the invention, the combined effect of such measures leads to magnetic steel sheets which in their magnetic and mechanical characteristics are superior to magnetic steel sheets made in the traditional way. Thus the invention results in a significant reduction of costs for producing high-quality magnetic steel sheets. Furthermore, based on the method according to the invention, sheets can be produced whose characteristics are far superior to those of conventionally produced magnetic steel sheets.

An advantageous embodiment of the invention is characterised in that the hot strip after deformation in the austenitic region is exclusively finish-rolled in the two-phase mixing region austenite/ferrite. In particular, with this variant of the invention, the total deformation $\epsilon_h$ achieved during rolling in the two-phase mixing region austenite/ferrite should be at least 50%. With this variant of the method according to the invention, rolling in the ferritic state of the hot strip is completely avoided. Strip made on the basis of Fe—Si steels, which have a pronounced two-phase mixing region austenite/ferrite at the transition from austenite to ferrite, are particularly suited to this sequence of rolling steps where there is no rolling in the ferritic region. Optimal temperature management in the sense of preventing cooling of the material to be rolled can be achieved and thus complete transformation to ferrite can be prevented by a suitable selection of the ratio of degree of transformation and speed of transformation, i.e. by utilising the heat generated during deformation.

According to an alternative variant of the process according to the invention, following rolling in the two-phase mixing region austenite/ferrite, at least one deformation pass is carried out in the ferritic region.

The total deformation $\epsilon_h$ achieved during rolling in the ferritic region should be at least 10% and at most 33%. With this embodiment of the invention too, rolling in the ferritic region is reduced to a minimum so that the emphasis of deformation remains in the mixing region of austenite/ferrite in spite of final rolling being in the ferritic region.

In principle, a coiling temperature of at least 700° C. is suitable for carrying out the method according to the invention. If this coiling temperature is maintained, hot-strip annealing can be done without entirely or at least to a substantial degree. The hot strip is already softened in the coil; this has a positive influence on the parameters which determine its characteristics, e.g. on grain size, texture and precipitation. In this context it is particularly advantageous if the coiled hot strip from the coiling heat is subjected to direct annealing and if the annealing time at an annealing temperature exceeding 700° C. is at least 15 minutes. Such in-line annealing of the hot strip which is coiled at high temperature and which is not significantly cooled down in the coil, can completely replace hot-strip batch-type annealing which may otherwise be required. Thus annealed hot strip with particularly good magnetic and technological characteristics can be produced. The expense in time and energy is considerably reduced when compared to hot-strip annealing which is conventionally carried out to improve the characteristics of magnetic steel sheets.

According to an embodiment of the invention which is particularly suitable for processing a steel with an Si content of at least 0.7 weight %, following rolling in the finish-rolling line, the hot strip is coiled at a coiling temperature of less than 600° C., in particular less than 550° C. With the respective alloys, coiling at these temperatures results in a strengthened hot-strip condition.

Preferably at least one of the last deformation passes in the ferritic region is carried out by hot-rolling with the use of lubricant. Hot-rolling with lubricant results in reduced shear deformation so that the structure of the rolled strip is more homogeneous across its cross-section. Furthermore, lubrication reduces the rolling forces so that a greater thickness reduction becomes possible for a given roll pass. Depending on the desired characteristics of the magnetic steel sheets to be produced it can therefore be advantageous if all deformation passes taking place in the ferritic region are carried out with roll lubrication.

Irrespective of the sequence of rolling steps selected in a particular case, further improvement in the characteristics of the magnetic steel strip produced can be achieved in that, following coiling and cooling, the hot strip is additionally annealed at an annealing temperature of at least 740° C. This annealing can be carried out in a batch-type annealing furnace or in a continuous furnace. In particular, if cast thin slabs or cast strip are/is used as an input stock, hot strip with a thickness of $\leqq$1.5 mm can be produced. In this context, strip of particularly high quality can be produced in that the cast input stock is produced in a casting and rolling plant and emanating from it, is directly fed to the roll train.

The characteristics of hot strip produced according to the invention are so good that for a multitude of applications the strip can be used directly as magnetic steel sheets without the need for renewed cold-rolling where cold working beyond smoothing or dressing is carried out. Thus in a preferred embodiment of the invention the hot strip is prepared for processing and supplied as magnetic steel sheets.

It must be noted that in cases where directly used input stock is processed to hot strip according to the invention, particularly good magnetic characteristics are achieved if hot-rolling is finished in the mixing region austenite/ferrite. It has been shown that in particular hot strip hot-rolled in such a way by avoiding the ferrite region is suitable for delivery to the end user without any further deformation as part of cold-rolling.

Furthermore it has been found that a hot strip produced according to the invention, if necessary pickled, can be used for certain applications without the need for any final cold working. For special requirements where improved processability of the magnetic hot strip produced according to the invention and supplied without distinct cold-rolling, is demanded, this can be achieved in that the pickled hot strip is flattened at a degree of deformation of ≦3%. As a result of flattening, uneven areas on the surface of the strip are smoothed without there being any significant influence on the microstructural condition produced as part of hot-rolling.

As an alternative or in addition to a pure smoothing pass of the type explained above, apart from an improvement in surface characteristics, the magnetic characteristics of the hot-rolled strip produced according to the invention can also be improved in that the pickled hot strip is temper-rolled at a degree of deformation of more than 3% but 15% at the most. Again, this subsequent rolling does not bring about any typical reduction in thickness which would be comparable to the change in strip thickness during typical cold-rolling because of the high degree of deformation achieved in this way. But rather, additional deformation energy is introduced into the strip which has a positive influence on subsequent processability of the temper-rolled strip.

The magnetic steel sheets which are supplied according to the invention as hot strip, can be subjected to final annealing, at an annealing temperature of ≧740° C. in the usual way before it is prepared for processing and delivery. By contrast, if final annealing is to be carried out at the processor's location, then a hot magnetic steel strip which has not been subjected to final annealing can be provided in that prior to preparation for processing and delivery, the hot strip undergoes recrystallising annealing at annealing temperatures >650° C. to form a magnetic steel strip which has not been subjected to final annealing.

Due to its mechanical characteristics, the hot strip produced according to the invention is however also particularly suited for single-stage or multi-stage rolling in the conventional way, to a final thickness. If cold-rolling is carried out in a multi-stage process, at least one of the cold-rolling stages should be followed by intermediate annealing, so as to maintain the good mechanical characteristics of the strip.

If a fully-finished magnetic steel strip is to be produced, then cold-rolling is followed by final annealing at an annealing temperature which is preferably >740° C.

By contrast, if a semi-finished magnetic steel strip is to be produced, then cold-rolling, which may have been carried out in several stages, is followed by recrystallising annealing in a hood-type annealing furnace or in a continuous furnace at temperatures of at least 650° C. Subsequently, the cold-rolled and annealed magnetic steel strip is levelled and rerolled.

Cold-rolled magnetic steel strip produced according to the invention has outstanding cutting and stamping characteristics and as such is particularly suitable for processing into components such as lamella or blanks. If semi-finished magnetic steel sheets are processed, it is advantageous if the components made from such magnetic steel sheets are subjected to final annealing at the user's location.

Irrespective of whether semi-finished or fully-finished magnetic steel sheets are produced, according to a further embodiment of the invention, final annealing of the cold-rolled magnetic steel sheets is preferably carried out in a decarburising atmosphere.

DETAILED DESCRIPTION OF THE INVENTION

Below, the invention is explained in more detail by means of exemplary embodiments.

Hereinafter, "J2500", "J5000" and "J10000" designate the magnetic polarisation at magnetic field strengths of 2500 A/m, 5000 A/m and 10000 A/m respectively.

"P 1.0" and "P 1.5" designate the hysteresis loss at a polarisation of 1.0 T and 1.5 T respectively, at a frequency of 50 Hz.

The magnetic characteristics shown in the following tables were obtained by measurements on individual strips, along the direction of rolling.

Table 1 lists the contents of the essential alloying constituents in weight % for three steels used for the production of magnetic steel sheets according to the invention.

TABLE 1

| Steel | C | Si | Al | Mn |
|---|---|---|---|---|
| A | 0.008 | 0.1 | 0.12 | 0.34 |
| B | 0.008 | 0.33 | 0.25 | 0.81 |
| C | 0.007 | 1.19 | 0.13 | 0.23 |

As an input stock, the slabs cast from steels A, B or C were reheated to a temperature exceeding 1000° C. and put though a finish-rolling line comprising several roll stands. In the finish-rolling line, at least the first deformation pass was carried out exclusively in the austenitic region.

Table 2 shows the magnetic characteristics $J_{2500}$, $J_{5000}$, $J_{10000}$, $P_{1.0}$ and $P_{1.5}$ for two magnetic steel sheets B1, B2 produced from steel A or B. Following rolling in the austenitic region, the respective hot strip destined for the production of magnetic steel sheets B1, B2 was finish-rolled in the two-phase mixing region austenite/ferrite at a total deformation $\epsilon_h$ of 66%. The rolled hot strip was then coiled at a coiling temperature of 750° C. Immediately thereafter, the coiled hot strip was cooled and conveyed for further processing.

TABLE 2

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| B1 | 1.739 | 1.813 | 1.9091 | 3.594 | 7.130 |
| B2 | 1.724 | 1.802 | 1.896 | 3.002 | 5.959 |

Table 3 shows the magnetic characteristics $J_{2500}$, $J_{5000}$, $J_{10000}$, $P_{1.0}$ and $P_{1.5}$ for magnetic steel sheets B3, B4 and B5.

Sheet B3 was produced from steel A; sheet B4 from steel B, and sheet B5 from steel C. Following deformation in the austenitic region, the hot strip destined for the production of magnetic sheets B3, B4 and B5 was also deformed exclusively in the two-phase mixing region austenite/ferrite. The total deformation $\epsilon_h$ during rolling in the mixing region was 66%. Subsequently the hot strip was coiled at a temperature of 750° C. However, in a procedure which differs to that applying to the magnetic steel sheets B1, B2, the hot strip destined for the production of the sheets B3, B4, B5 was then held at the coiling temperature for at least 15 minutes before being conveyed for processing into cold strip.

TABLE 3

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| B3 | 1.755 | 1.828 | 1.920 | 3.258 | 6.522 |
| B4 | 1.737 | 1.812 | 1.909 | 3.075 | 6.101 |
| B5 | 1.689 | 1.765 | 1.859 | 2.596 | 5.304 |

Table 4 shows the magnetic characteristics $J_{2500}$, $J_{5000}$, $J_{10000}$, $P_{1.0}$ and $P_{1.5}$ for magnetic steel sheets B6, B7 and B8, which sheets, in the order stated, were also produced from steels A, B or C respectively. Following deformation in the austenitic region, the respective hot strip destined for the production of magnetic steel sheets B6, B7 and B8 was finish-rolled in the two-phase mixing region austenite/ferrite. The total deformation $\epsilon_h$ achieved in the two-phase mixing region was 50%. The hot strip was then subjected to several deformation passes in the ferritic region. The total deformation $\epsilon_h$ achieved in the ferritic region was less than 30%. The hot strip which was finish-rolled in such a way was then coiled at a temperature of 750° C. Immediately thereafter, the hot strip was cooled in the coil.

TABLE 4

| Sheet | $J_{2500}$ [T] | $J_{5000}$ [T] | $P_{10000}$ [T] | $J_{1.0}$ [W/kg] | $P_{1.5}$ [W/kg] |
|---|---|---|---|---|---|
| B6 | 1.748 | 1.822 | 1.916 | 3.564 | 7.121 |
| B7 | 1.721 | 1.797 | 1.893 | 2.935 | 5.868 |
| B8 | 1.709 | 1.791 | 1.884 | 2.630 | 5.246 |

Table 5 shows the magnetic characteristics $J_{2500}$, $J_{5000}$, $J_{10000}$, $P_{1.0}$ and $P_{1.5}$ for magnetic steel sheets B9, B10 and B11. Sheet B9 was produced from steel A; sheet B10 from steel B, and sheet B11 from steel C. The hot strip destined for the production of magnetic sheets B9, B10 and B11 was subjected to the same deformation in the finish-rolling line, as was the case with the strip destined for the production of sheets B6, B7 and B8. The hot strip finish-rolled in this way was coiled at a temperature of 750° C. However, in a procedure which differs from that applying to the magnetic steel sheets B6, B7 and B8, the hot strip destined for the production of sheets P9, B10, B11 was then held at the coiling temperature for at least 15 minutes before being conveyed for processing into cold strip.

TABLE 5

| Sheet | $J_{2500}$ [T] | $J_{5000}$ [T] | $P_{10000}$ [T] | $J_{1.0}$ [W/kg] | $P_{1.5}$ [W/kg] |
|---|---|---|---|---|---|
| B9 | 1.746 | 1.819 | 1.914 | 3.305 | 6.657 |
| B10 | 1.731 | 1.805 | 1.901 | 2.909 | 5.811 |
| B11 | 1.690 | 1.765 | 1.858 | 2.587 | 5.304 |

Table 6 shows the magnetic characteristics $J_{2500}$, $J_{5000}$, $J_{10000}$, $P_{1.0}$ and $P_{1.2}$ for a magnetic steel sheet B12 which was produced from steel C. After deformation in the austenitic region, the hot strip destined for the production of magnetic sheet B12 was deformed exclusively in the two-phase mixing region austenite/ferrite. The total deformation $\epsilon_h$ achieved in the two-phase mixing region was 66%. The finish-rolled hot strip was then coiled at a temperature of less than 600° C. Immediately thereafter, the hot strip was cooled in the coil.

TABLE 6

| Sheet | $J_{2500}$ [T] | $J_{5000}$ [T] | $J_{10000}$ [T] | $J_{1.0}$ [W/kg] | $P_{1.5}$ [W/kg] |
|---|---|---|---|---|---|
| B12 | 1.724 | 1.800 | 1.894 | 2.577 | 5.105 |

Table 7 lists the contents of the essential alloying constituents in weight % for two further steels used for the production of hot strip produced according to the invention and subsequently prepared for processing without distinct cold-rolling, and supplied as magnetic steel sheets.

TABLE 7

| Steel | C | Si | Al | Mn |
|---|---|---|---|---|
| C | 0.008 | 0.10 | 0.12 | 0.34 |
| D | 0.007 | 1.19 | 0.13 | 0.23 |

Melts formed according to the compositions shown in table 7 were continuously cast in a casting and rolling plant to form a roughed strip which was continuously conveyed to a hot-roll line comprising several roll stands. During hot-rolling of the respectively produced magnetic steel sheets C1–C3 and D1–D3, the main emphasis on deformation was carried out in the region where the respective strip was in the austenitic state. The last pass of hot-rolling was however carried out according to the invention in the mixing region austenite/ferrite. The total deformation $\epsilon_H$ achieved was 40%. Subsequently the hot strip was coiled at a temperature of 750° C.

Tables 8a–8c show the magnetic characteristics $J_{2500}$, $J_{5000}$, $J_{10000}$, $P_{1.0}$ and $P_{1.5}$ for the three magnetic steel sheets C1–C3 or D1–D3 produced from the steels C or D.

In the case of examples C1, D1(Table 8a), after cooling, the hot strip was directly prepared for processing into commercially available magnetic steel sheets and supplied to the end user. In the case of examples C2, D2 (Table 8b), prior to delivery to the end user, the hot strip was pickled and additionally subjected to a smoothing pass. During this smoothing pass, a deformation $\epsilon_H$ of max. 3% was achieved. Prior to delivery, strips C3, D3 (Table 8c) were pickled and then temper-rolled.

TABLE 8a

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| C1 | 1.646 | 1.729 | 1.522 | 5.941 | 13.276 |
| D1 | 1.642 | 1.716 | 1.548 | 4.095 | 9.647 |

TABLE 8b

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| C2 | 1.661 | 1.735 | 1.577 | 5.409 | 13.285 |
| D2 | 1.621 | 1.699 | 1.535 | 3.716 | 8.776 |

TABLE 8c

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| C3 | 1.642 | 1.716 | 1.548 | 4.095 | 9.647 |
| D3 | 1.608 | 1.686 | 1.529 | 3.023 | 7.447 |

It has been shown that the magnetic steel sheets C1–C3 or D1–D3, too, which were produced according to the invention as hot strip and as such were supplied to the end user without distinct cold-rolling, have outstanding magnetic characteristics which render them suitable, without further ado, for use in a multitude of applications.

Comparison tests were carried out on magnetic steel sheets, 1 mm in thickness, produced according to the method according to the invention, and on magnetic sheets which were hot-rolled and cold-rolled in the conventional way. These tests showed that the achievable values of the magnetic polarisation and the achievable values of the specific hysteresis losses of the magnetic steel sheets produced according to the invention, agree within very close ranges with those values determined for the respective characteristics in conventionally produced magnetic steel sheets.

What is claimed is:

1. A method for producing non grain-oriented magnetic steel sheet comprising:

producing a hot strip from an input stock in form of cast slabs, strip, roughed strip, or thin slabs, said input stock being made of steel comprising in weight %:

C:0.001–0.05%

Si: ≦1.5%

Al: ≦0.4% with Si+2 Al≦1.7% optionally up to a total of 1.5% alloying additions selected from the group consisting of P, Sn, Sb, Zr, V, Ti, N, Ni, Co, Nb and B; balance iron and inevitable impurities wherein the input stock is hot rolled to form a hot strip directly from the casting heat or after preceding reheating to a reheating temperature between minimum 1000° C. and maximum 1180° C. in several deformation passes; and subsequently coiling said hot strip in a coil at a coiling temperature; wherein at least the first deformation pass during the hot-rolling step is carried out in a austenitic region, and at least one further deformation pass is carried out in a two phase austenite/ferrite region, and wherein a total deformation $\epsilon_h$ of at least 35% is achieved during the hot-rolling step in the two phase austenite/ferrite region.

2. The method of claim 1, wherein the total deformation $\epsilon_h$ is 60% maximum.

3. The method of claim 1, further comprising finish rolling the hot strip exclusively in the two phase austenite/ferrite region after deformation in the austenitic region.

4. The method of claim 1, wherein the total deformation $\epsilon_h$ achieved during the hot-rolling step in the two-phase austenite/ferrite region is at least 50%.

5. The method of claim 1, wherein following the hot-rolling step in the two-phase austenite/ferrite region, at least one deformation pass is carried out in a ferritic region.

6. The method of claim 5, wherein a total deformation $\epsilon_h$ achieved during hot-rolling in the ferritic region is at least 10% and at most 33%.

7. The method of claim 1, wherein the coiling temperature is at least 700° C.

8. The method of claim 7, further comprising subjecting the coiled hot strip from a coiling heat to direct annealing wherein annealing time at an annealing temperature exceeding 700° C. is at least 15 minutes.

9. The method of claim 6, wherein the steel comprises a Si content of at least 0.7 weight %.

10. The method of claim 1, wherein the coiling temperature is less than 600° C.

11. The method of claim 9, further comprising immediately following coiling, subjecting the hot strip to accelerated cooling in the coil.

12. The method of claim 1, wherein during the hot-rolling step in the ferritic region, at least one deformation pass is carried out with the use of lubricant.

13. The method of claim 12, wherein all deformation passes taking place in the ferritic region are carried out with roll lubrication.

14. The method of claim 1, further comprising annealing the hot strip after the coiling step at an annealing temperature of at least 740° C.

15. The method of claim 14, further comprising annealing the coiled hot strip in a batch-type annealing furnace.

16. The method of claim 14, wherein the annealing step is carried out in a continuous furnace.

17. The method of claim 1, wherein the thickness of the coiled hot strip is ≦1.5 mm.

18. The method of claim 1, further comprising preparing the hot strip for further processing and supplying said processed hot strip as magnetic steel sheets.

19. The method of claim 18, further comprising planishing the hot strip at a degree of deformation of ≦3% prior preparation for the processing and the supplying steps.

20. The method of claim 18, further comprising temper rolling the hot strip at a degree of deformation of >3–15% prior the preparation for the processing and the supplying steps.

21. The method of claim 18, further comprising subjecting the hot strip to final annealing, at an annealing temperature of >740° C. prior the preparation for the processing and the supplying steps.

22. The method of claim 18, further comprising prior to preparation for processing and delivery subjecting the hot strip to recrystallising annealing at annealing temperatures >650° C. to form a magnetic steel strip which has not been subjected to final annealing.

23. The method of claim 16, further comprising cold rolling the hot strip in single-stage or multi-stage rolling, to a final thickness.

24. The method of claim 23, further comprising cold rolling the hot strip in several stages wherein at least one of the cold-rolling stages is followed by intermediate annealing.

25. The method of claim 23, further comprising subjecting the cold strip to final annealing following cold rolling, said final annealing taking place at an annealing temperature of >740° C.

26. The method of claim 23, wherein following the cold-rolling step, the cold strip is subjected to recrystallising annealing in a batch-type annealing furnace or in a continuous furnace at annealing temperature of at least 650° C. to form a magnetic steel strip which has not been subjected to final annealing, said cold strip being subsequently leveled and rerolled.

27. The method of claim 26, wherein the annealing step is carried out in a decarburising atmosphere.

28. The method of claim 1, wherein the steel comprises up to a total of 1.5% of alloying additions selected from the group consisting of P, Sn, Sb, Zr, V, Ti, N, Ni, Co, Nb or B.

29. The method of claim 1, wherein the coiling temperature is less than 550° C.

30. The method of claim 8 further comprising cold rolling the hot strip in single-stage or multi-stage rolling, to a final thickness.

31. The method of claim 30, further comprising cold rolling the hot strip in several stages wherein at least one of the cold-rolling stages is followed by intermediate annealing.

32. The method of claim 30, further comprising subjecting the cold strip to final annealing following cold rolling, said final annealing taking place at an annealing temperature of >740° C.

33. The method of claim 30, wherein following the cold-rolling step the cold strip is subjected to recrystallising annealing in a batch-type annealing furnace or in a continuous furnace at annealing temperature of at least 650° C. to form a magnetic steel strip which has not been subjected to final annealing, said cold strip being subsequently leveled and rerolled.

34. The method of claim 33 wherein the annealing step is carried out in a decarburising atmosphere.

35. The method of claim 11 further comprising cold rolling the hot strip in single-stage or multi-stage rolling, to a final thickness.

36. The method of claim 35, further comprising cold rolling the hot strip in several stages wherein at least one of the cold-rolling stages is followed by intermediate annealing.

37. The method of claim 35, further comprising subjecting the cold strip to final annealing following cold rolling, said final annealing taking place at an annealing temperature of >740° C.

38. The method of claim 35, wherein following the cold-rolling step the cold strip is subjected to recrystallising annealing in a batch-type annealing furnace or in a continuous furnace at annealing temperature of at least 650° C. to form a magnetic steel strip which has not been subjected to final annealing, said cold strip being subsequently leveled and rerolled.

39. The method-of claim 35 wherein the annealing step is carried out in a decarburising atmosphere.

40. The method of claim 14 further comprising cold rolling the hot strip in single-stage or multi-stage rolling, to a final thickness.

41. The method of claim 40, further comprising cold rolling-the hot strip in several stages wherein at least one of the cold-rolling stages is followed by intermediate annealing.

42. The method of claim 40, further comprising subjecting the cold strip to final annealing following cold rolling, said final annealing taking place at an annealing temperature of >740° C.

43. The method of claim 40, wherein following the cold-rolling step the cold strip is subjected to recrystallising annealing in a batch-type annealing furnace or in a continuous furnace at annealing temperature of at least 650° C. to form a magnetic steel strip which has not been subjected to final annealing, said cold strip being subsequently leveled and rerolled.

44. The method-of claim 40 wherein the annealing step is carried out in a decarburising atmosphere.

* * * * *